US007598799B2

(12) United States Patent
Marinca

(10) Patent No.: US 7,598,799 B2
(45) Date of Patent: Oct. 6, 2009

(54) BANDGAP VOLTAGE REFERENCE CIRCUIT

(75) Inventor: Stefan Marinca, Dooradoyle (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 12/004,799

(22) Filed: Dec. 21, 2007

(65) Prior Publication Data

US 2009/0160537 A1 Jun. 25, 2009

(51) Int. Cl.
*G05F 1/10* (2006.01)

(52) U.S. Cl. ..... 327/539

(58) Field of Classification Search ..... 323/313; 327/535, 537, 539

See application file for complete search history.

(56) References Cited

U.S. PATENT DOCUMENTS

| | | | | |
|---|---|---|---|---|
| 4,399,398 | A | 8/1983 | Wittlinger | |
| 4,475,103 | A | 10/1984 | Brokaw et al. | |
| 4,603,291 | A | 7/1986 | Nelson | |
| 4,714,872 | A | 12/1987 | Traa | |
| 4,800,339 | A | 1/1989 | Tanimoto et al. | |
| 4,808,908 | A | 2/1989 | Lewis et al. | |
| 4,939,442 | A | 7/1990 | Carvajal et al. | |
| 5,053,640 | A | 10/1991 | Yum | |
| 5,119,015 | A | 6/1992 | Watanabe | |
| 5,229,711 | A | 7/1993 | Inoue | |
| 5,325,045 | A | 6/1994 | Sundby | |
| 5,352,973 | A | 10/1994 | Audy | |
| 5,371,032 | A | 12/1994 | Nishihara | |
| 5,424,628 | A | 6/1995 | Nguyen | |
| 5,512,817 | A | 4/1996 | Nagaraj | |
| 5,563,504 | A | 10/1996 | Gilbert et al. | |
| 5,646,518 | A | 7/1997 | Lakshmikumar et al. | |
| 5,821,807 | A | 10/1998 | Brooks | |
| 5,828,329 | A | 10/1998 | Burns | |
| 5,933,045 | A | 8/1999 | Audy et al. | |
| 5,952,873 | A * | 9/1999 | Rincon-Mora | 327/539 |
| 5,982,201 | A | 11/1999 | Brokaw et al. | |

(Continued)

FOREIGN PATENT DOCUMENTS

| | | |
|---|---|---|
| EP | 0510530 | 10/1992 |

(Continued)

OTHER PUBLICATIONS

PCT/EP2008/058685 International Search Report and written opinion, Oct. 1, 2008.

(Continued)

*Primary Examiner*—Jeffrey S Zweizig
(74) *Attorney, Agent, or Firm*—Wolf, Greenfield & Sacks, P.C.

(57) ABSTRACT

A bandgap voltage reference circuit with an inherent curvature correction which comprises an amplifier having an inverting terminal, a non-inverting terminal and an output terminal is described. A first and second bipolar transistor operable at different current densities are provided each of the transistors being coupled to a corresponding one of the inverting and non-inverting terminals of the amplifier such that a ΔVbe is reflected across a first load element. A current biasing circuit is provided which includes a semiconductor device coupled to each of the first and second bipolar transistors and is configured for applying a non-linear bias current to the first and second bipolar transistors for biasing thereof.

27 Claims, 3 Drawing Sheets

U.S. PATENT DOCUMENTS

| | | | | |
|---|---|---|---|---|
| 6,002,293 | A | 12/1999 | Brokaw | |
| 6,075,354 | A | 6/2000 | Smith et al. | |
| 6,157,245 | A | 12/2000 | Rincon-Mora | |
| 6,218,822 | B1 | 4/2001 | MacQuigg | |
| 6,225,796 | B1 | 5/2001 | Nguyen | |
| 6,255,807 | B1 | 7/2001 | Doorenbos et al. | |
| 6,329,804 | B1 | 12/2001 | Mercer | |
| 6,329,868 | B1 | 12/2001 | Furman | |
| 6,356,161 | B1 | 3/2002 | Nolan et al. | |
| 6,362,612 | B1 | 3/2002 | Harris | |
| 6,373,330 | B1 | 4/2002 | Holloway | |
| 6,426,669 | B1 | 7/2002 | Friedman et al. | |
| 6,462,625 | B2 | 10/2002 | Kim | |
| 6,483,372 | B1 | 11/2002 | Bowers | |
| 6,489,787 | B1 | 12/2002 | McFadden | |
| 6,489,835 | B1 | 12/2002 | Yu et al. | |
| 6,501,256 | B1 | 12/2002 | Jaussi et al. | |
| 6,529,066 | B1 | 3/2003 | Guenot et al. | |
| 6,531,857 | B2 | 3/2003 | Ju | |
| 6,549,072 | B1 | 4/2003 | Vernon | |
| 6,590,372 | B1 | 7/2003 | Wiles, Jr. | |
| 6,614,209 | B1 | 9/2003 | Gregoire, Jr. | |
| 6,642,699 | B1 | 11/2003 | Gregoire, Jr. | |
| 6,661,713 | B1 | 12/2003 | Kuo | |
| 6,664,847 | B1 | 12/2003 | Ye | |
| 6,690,228 | B1 | 2/2004 | Chen et al. | |
| 6,791,307 | B2 | 9/2004 | Harrison | |
| 6,798,286 | B2 | 9/2004 | Dauphinee et al. | |
| 6,801,095 | B2 | 10/2004 | Renninger, II | |
| 6,828,847 | B1 | 12/2004 | Marinca | |
| 6,836,160 | B2 | 12/2004 | Li | |
| 6,853,238 | B1 | 2/2005 | Dempsey et al. | |
| 6,885,178 | B2 | 4/2005 | Marinca | |
| 6,891,358 | B2 | 5/2005 | Marinca | |
| 6,894,544 | B2 | 5/2005 | Gubbins | |
| 6,919,753 | B2 | 7/2005 | Wang et al. | |
| 6,930,538 | B2 | 8/2005 | Chatal | |
| 6,958,643 | B2 | 10/2005 | Rosenthal | |
| 6,987,416 | B2 * | 1/2006 | Ker et al. | 327/539 |
| 6,992,533 | B2 | 1/2006 | Hollinger et al. | |
| 7,012,416 | B2 | 3/2006 | Marinca | |
| 7,057,444 | B2 | 6/2006 | Illegems | |
| 7,068,100 | B2 | 6/2006 | Dauphinee et al. | |
| 7,088,085 | B2 | 8/2006 | Marinca | |
| 7,091,761 | B2 | 8/2006 | Stark | |
| 7,112,948 | B2 | 9/2006 | Daly et al. | |
| 7,170,336 | B2 | 1/2007 | Hsu | |
| 7,173,407 | B2 | 2/2007 | Marinca | |
| 7,193,454 | B1 | 3/2007 | Marinca | |
| 7,199,646 | B1 | 4/2007 | Zupcau et al. | |
| 7,211,993 | B2 | 5/2007 | Marinca | |
| 7,224,210 | B2 | 5/2007 | Garlapati et al. | |
| 7,236,047 | B2 | 6/2007 | Tachibana et al. | |
| 7,248,098 | B1 * | 7/2007 | Teo | 327/539 |
| 7,260,377 | B2 | 8/2007 | Burns et al. | |
| 7,301,321 | B1 | 11/2007 | Uang et al. | |
| 7,372,244 | B2 | 5/2008 | Marinca | |
| 7,411,380 | B2 * | 8/2008 | Chang et al. | 323/314 |
| 7,472,030 | B2 | 12/2008 | Scheuerlein | |
| 7,482,798 | B2 * | 1/2009 | Han | 323/316 |
| 2003/0234638 | A1 * | 12/2003 | Eshraghi et al. | 323/315 |
| 2005/0073290 | A1 | 4/2005 | Marinca et al. | |
| 2005/0194957 | A1 | 9/2005 | Brokaw | |
| 2005/0237045 | A1 | 10/2005 | Lee et al. | |
| 2006/0017457 | A1 | 1/2006 | Pan et al. | |
| 2006/0038608 | A1 | 2/2006 | Ozawa | |
| 2008/0018319 | A1 | 1/2008 | Chang et al. | |
| 2008/0074172 | A1 | 3/2008 | Marinca | |
| 2008/0224759 | A1 | 9/2008 | Marinca | |
| 2008/0265860 | A1 | 10/2008 | Dempsey et al. | |

FOREIGN PATENT DOCUMENTS

| | | | |
|---|---|---|---|
| EP | 1359490 | A2 | 11/2003 |
| EP | 1359490 | A3 | 11/2003 |
| JP | 4-167010 | | 6/1992 |
| KR | 0115143 | | 12/2007 |

OTHER PUBLICATIONS

PCT/EP2008/051161 International Search Report and written opinion, May 16, 2008.

Chen, Wai-Kai, "The circuits and filters handbook", 2nd ed, CRC Press, 2003.

Cressler, John D., "Silicon Heterostructure Handbook", CRC Press-Taylor & Francis Group, 2006; 4.4-427-438.

Gray, Paul R., et al, *Analysis and Design of Analog Integrated Circuits*, Chapter 4, 4th ed., John Wiley & Sons, Inc., 2001, pp. 253-327.

PCT/EP2005/052737 International Search Report, Sep. 23, 2005.

Banba et al, "A CMOS bandgap reference circuit with Sub-1-V operation", IEEE JSSC vol. 34, No. 5, May 1999, pp. 670-674.

Brokaw, A. Paul, "A simple three-terminal IC bandgap reference", IEEE Journal of Solid-State Circuits, vol. SC-9, No. 6, Dec. 1974, pp. 388-393.

Jones, D.A., and Martin, K., "Analog Integrated Circuit Design", John Wiley & Sons, USA, 1997 (ISBN 0-47L-L4448-7, pp. 353-363).

Malcovati et al, "Curvature-compensated BiCMOS bandgap with 1-V supply voltage", IEEE JSSC, vol. 36, No. 7, Jul. 2001.

Sudha et al, "A low noise sub-bandgap voltage reference", IEEE, Proceedings of the 40th Midwest Symposium on Circuits and Systems, 1997. vol. 1, Aug. 3-6, 1997, pp. 193-196.

Widlar, Robert J., "New developments in IC voltage regulators", IEEE Journal of Solid-State Circuits, vol. SC-6, No. 1, Feb. 1971, pp. 2-7.

Jianping, Zeng, et al, "CMOS Digital Integrated temperature Sensor", IEEE, Aug. 2005, pp. 310-313.

PCT/EP2008/067402 International Search Report, Mar. 20, 2009.

* cited by examiner

BANDGAP VOLTAGE REFERENCE CIRCUIT

FIELD OF THE INVENTION

The present invention relates to curvature corrected bandgap voltage reference circuits.

BACKGROUND

Bandgap voltage reference circuits are well known in the art. Such circuits are designed to sum two voltages with opposite temperature slopes. One of the voltages is a Complementary-To-Absolute Temperature (CTAT) voltage typically provided by a base-emitter voltage of a forward biased bipolar transistor. The other is a Proportional-To-Absolute Temperature (PTAT) voltage typically derived from the base-emitter voltage differences of two bipolar transistors operating at different collector current densities. When the PTAT voltage and the CTAT voltage are summed together the summed voltage is at a first order temperature insensitive. The voltage reference signals provided by bandgap voltage reference circuits known heretofore require curvature correction due to the non-linearity of base-emitter voltage as explained below. The base-emitter voltage of a bipolar transistor is temperature dependent and can be defined by equation (1).

$$V_{be}(T) = V_{G0}\left(1 - \frac{T}{T_0}\right) + V_{be}(T_0) * \frac{T}{T_0} - XTI * V_{T0} * \frac{T}{T_0} * \ln\left(\frac{T}{T_0}\right) + V_{T0} * \frac{T}{T_0} * \ln\left(\frac{Ic(T)}{Ic(T_0)}\right) \quad (1)$$

Where:

$V_{be}(T)$ is base-emitter voltage at actual temperature, T, $V_{be0}$ is base-emitter voltage at temperature $T_0$ (~0.65V at $T_0$=300K), $V_{G0}$ is extrapolated bandgap voltage at 0K (~1.14V), XTI corresponds to saturation current temperature exponent (~3 to 5), $V_{T0}$ is thermal voltage at temperature $T_0$ (~25.8 mV at $T_0$=300K).

The collector currents of bipolar transistors correspond to a ratio of a voltage, $V_R$, (PTAT, CTAT, constant or combinations) over a resistor, R. The resistor is also temperature dependent such that:

$$\frac{Ic(T)}{Ic(T_0)} \approx \left(\frac{T}{T_0}\right)^c \quad (2)$$

Temperature exponent, c, in equation (2) corresponds to temperature dependence of $V_R$ and resistor R.

Combining equation (1) and equation (2):

$$V_{be}(T) = V_{G0}\left(1 - \frac{T}{T_0}\right) + V_{be}(T_0) * \frac{T}{T_0} - (XTI - c) * V_{T0} * \frac{T}{T_0} * \ln\left(\frac{T}{T_0}\right) \quad (3)$$

If voltage $V_R$ is PTAT and R has zero temperature coefficient (TC) then c=1. The last term in equation (3) corresponds to non-linearity of base-emitter voltage which is also reflected in the reference voltage since the PTAT voltage component of the reference voltage has very low non-linearity. When the reference voltage is trimmed for minimum TC this nonlinearity displays a voltage variation of the form of a "bow" or curve with maximum deviation in the middle of the industrial temperature range (−40° C. to 85° C.). For a reference voltage with nominal voltage of about 1.24V implemented in a submicron CMOS process maximum voltage deviation due to the nonlinear term is of the order of 2 mV to 5 mV. Accordingly for industrial temperature ranges (typically −40° C. to 85° C.) the TC cannot be reduced to less than 10 to 20 ppm/° C. without further curvature correction.

An example of a prior art bandgap voltage reference circuit 100 is illustrated in FIG. 1. This circuit is exemplary of the type of prior art circuitry which requires curvature correction. The bandgap voltage reference circuit 100 includes a first bipolar transistor 110 operating at first collector current density and a second bipolar transistor 115 operating at a second collector current density which is less than that of the first collector current density. The emitter of the first bipolar transistor 110 is coupled to the non-inverting terminal of an operational amplifier 118, and the emitter of the second bipolar transistor 115 is coupled via a resistor, r1, 122 to the inverting terminal of the amplifier 118. The collector current density difference may be established by having the emitter area of the second bipolar transistor 115 larger than the emitter area of the first bipolar transistor 110. Alternatively multiple transistors may be provided in each leg, with the sum of the collector currents of each of the transistors in a first leg being greater than that in a second leg. As a consequence of the differences in collector current densities between the transistors coupled to each of the legs of the amplifier, a base-emitter voltage difference ($\Delta V_{be}$) is reflected across the resistor, r1, 122. This voltage difference is of the form of a proportional to absolute temperature (PTAT) voltage. Two PMOS transistor 130A, 130B provide bias current to the first and second bipolar transistors, respectively. If the two PMOS transistors 130A and 130B are assumed to be identical; the amplifier 118 is operable as an ideal amplifier and the base currents of the first bipolar transistor 110 and the second bipolar transistor 115 are negligible compared to the corresponding emitter and collector currents. The PTAT voltage developed across resistor r1, 122 is:

$$\Delta V_{be} = V_{T0} * \frac{T}{T_0} * \ln(n) \quad (4)$$

The reference voltage at the output node 140 corresponds to base-emitter voltage of the first bipolar device 110 plus the base-emitter voltage difference $\Delta V_{be}$ scaled by the ratio of resistor 122 and a feedback resistor, r2, 133 coupled to the inverting terminal of the amplifier 118 and the output node 140.

$$V_{ref} = V_{be} + \Delta V_{be} * \frac{r1}{r2} \quad (5)$$

As the collector currents of the first and second bipolar transistors are PTAT the coefficient "c" in equation (3) is one and the non-linear component of the form of T log T is scaled by the factor of XTI-1. Different correction methods are used to compensate for nonlinearity of the form of T log T in bandgap voltage references.

Known correction methods introduce an inverse curvature on base-emitter voltage difference of suitable magnitude such that when they are combined to generate the reference voltage, the two pairs of linear and nonlinear voltage components compensate for each other. In order to apply such a signal, the bipolar transistors 110, 115 which generate the bandgap voltage reference are biased with different currents. Typically, the bipolar transistor 115 operating at the lower collector current density is biased with constant current and the bipolar transistor 110 operating with high collector current density is biased with PTAT current. Different biasing circuits are used to generate the required constant current for biasing the bipolar transistor 110. Such biasing circuits typically require an extra amplifier and a large resistor to reflect across it a constant voltage or a CTAT voltage. When CTAT voltage is used a CTAT current is generated, and this current is added to a balanced PTAT current to generate a constant current.

While such circuitry provides for the necessary curvature compensation it does so at the expense of die area in that the components used, the additional amplifier and the large resistor typically occupy large areas on the die where the circuitry is provided.

There is therefore a need to provide a bandgap voltage reference that compensates for voltage reference curvature but does not require large area devices to achieve this compensation.

SUMMARY

These and other problems are addressed by providing a bandgap voltage reference circuit configured to correct for reference voltage curvature. Such a bandgap voltage reference circuit may be implemented by incorporating a current biasing circuit including a semiconductor for applying a non-linear bias current to bias two bipolar transistors operating at different collector current densities. In this way, the generated voltage reference is inherently corrected as opposed to require subsequent circuitry to achieve curvature correction. In accordance with the teaching of the present invention the reference voltage curvature component may be reduced by effecting an increase in the coefficient "c" in equation (3). This may desirably be achieved by biasing bipolar transistors of a bandgap cell with currents having stronger temperature dependence. Ideally if the coefficient c is provided of the form c=XTI the base-emitter voltage non-linearity is zero.

These and other features will be better understood with reference to the followings Figures which are provided to assist in an understanding of the teaching of the invention.

BRIEF DESCRIPTION OF THE DRAWINGS

The present application will now be described with reference to the accompanying drawings in which.

DETAILED DESCRIPTION OF THE DRAWINGS

The invention will now be described with reference to some exemplary bandgap reference voltage circuits which are provided to assist in an understanding of the teaching of the invention. It will be understood that these circuits are provided to assist in an understanding and are not to be construed as limiting in any fashion. Furthermore, circuit elements or components that are described with reference to any one Figure may be interchanged with those of other Figures or other equivalent circuit elements without departing from the spirit of the present invention.

Figure 2:
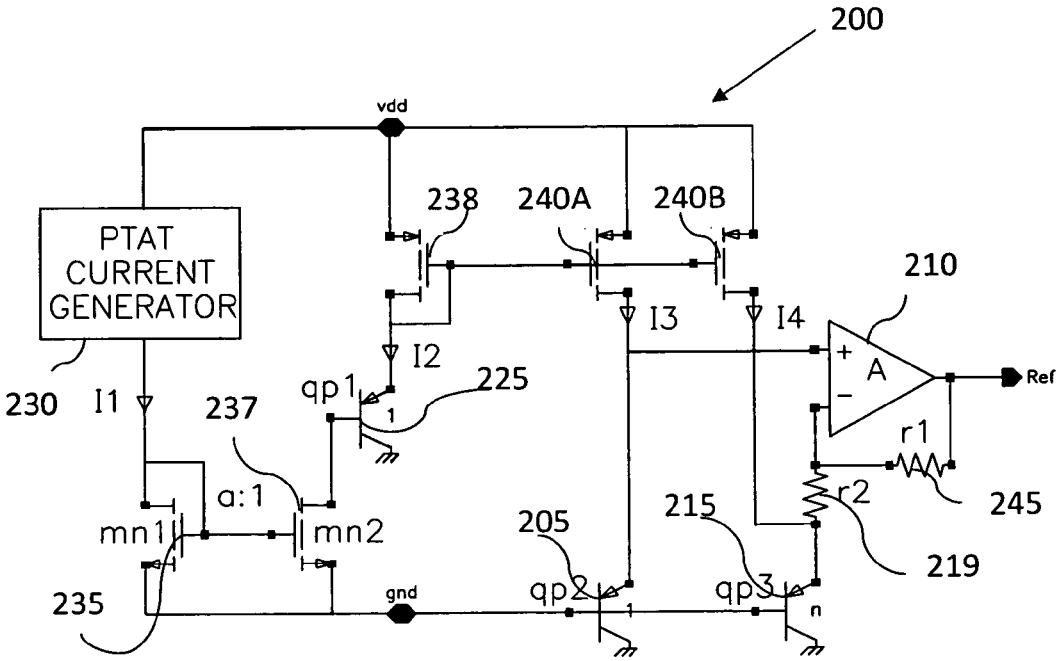
FIG. 2 is a schematic circuit diagram of a circuit provided in accordance with the teaching of the present invention.

Referring to the drawings and initially to FIG. 2 there is illustrated a bandgap voltage reference circuit 200 with inherent reference voltage curvature correction. The circuit 200 comprises a first bipolar transistor qp2, 205 which has its emitter coupled to the non-inverting terminal of an operational amplifier (op-amp) A, 210, and a second bipolar transistor, qp3, 215 which has its emitter coupled to the inverting terminal of the op-amp 210 via a sense resistor r2, 219. The base and collectors of both the first and second bipolar transistors 205, 215 are coupled to ground. The emitter area of the second bipolar transistor 215 is a constant "n" times larger than the emitter area of the first bipolar transistor 205 such that the collector current density of the first bipolar transistor 205 is greater than the collector current density of the second bipolar transistor 215. As was described above with reference to a typical known bandgap cell such differences in collector current density in each of the two legs coupled to the amplifier A may be achieved in any one of a number of different ways and it is not intended to limit the teaching of the present invention to any one specific arrangement.

The first bipolar transistor qp2, 205 and the second bipolar transistor qp3, 215 are biased by a non-linear current provided by a current biasing circuit which includes a semiconductor device, in this example, a third bipolar device qp1, 225. The base of the third bipolar transistor 225 receives a linear PTAT current from a PTAT current generator 230 and transforms the linear PTAT current into a non-linear biasing current in the form of an emitter current with an inherent collector to base current ratio factor beta ($\beta_F$).

$$\beta_F(T) = \beta_{F0} * \left(\frac{T}{T_0}\right)^b \tag{6}$$

A first and second mirroring arrangement is configured for delivering the linear PTAT current to the base of the third bipolar transistor 225 from the PTAT current generator 230, and for delivering the emitter current of the third bipolar transistor 225 to the emitters of each of the first and second bipolar transistors. The first mirroring arrangement comprises a first NMOS transistor 235 in a diode configuration coupled to the gate of a second NMOS transistor 237 and the PTAT current generator 230 for delivering the PTAT linear current from the PTAT current generator 230 to the base of the third bipolar transistor 225. The collector of the third bipolar transistor and the sources of both NMOS transistors 235, 237 are coupled to ground. The second mirror arrangement includes a first PMOS transistor 238 in a diode configuration coupled to the gates of second and third PMOS transistors 240A, 240B and the emitter of the third bipolar transistor 225 for delivering the emitter current of the third bipolar device 225 to each of the first and second bipolar devices 205, 215. The drain of the second PMOS transistor 240A is coupled to the emitter of the first bipolar transistor 205, and the drain of the third PMOS transistor 240B is coupled to the emitter of the second bipolar transistor 215. The sources of the PMOS transistors 238, 240A and 240B are coupled to a power supply $V_{DD}$.

In this example, the 'Length' (L) and 'Width' (W) aspect ratios of the second NMOS transistor 237 are scaled relative to the W/L aspect ratios of the first NMOS transistor 235 such that the linear PTAT current from the PTAT current generator is scaled down by a factor "a". It is desirable to bias the first bipolar transistor 205 and the second bipolar transistor 215 with currents of the same order of magnitude in the middle of the industrial temperature range −40° C. to 85° C. Thus, for optimum performance;

$$a \approx \beta_F \tag{7}$$

The sense resistor r2, 219 is coupled at one end to the emitter of the second bipolar transistor 215 and the other end to the inverting terminal of op-amp A, 210 across which a base emitter voltage difference ΔVbe (PTAT) is developed.

$$\Delta V_{be} = (kT/q)(\ln(n)) \tag{8}$$

Where, k is the Boltzmann constant, q is the charge on the electron,

T is the operating temperature in Kelvin, n is the collector current density ratio of the first and second bipolar transistors.

A feedback resistor, r1, 245 is provided in a feedback path between the inverting terminal and the output terminal of the op-amp 210. The voltage level at the non-inverting terminal of the op-amp 210 is equivalent to the base emitter voltage of the first bipolar transistor 205. As a consequence the voltage at the non-inverting terminal of the op-amp 210 is also equivalent the base emitter voltage of the first bipolar transistor 205. As the voltage drop across the sense resistor r2, 219 has a PTAT form, the voltage drop across the feedback resistor r1, 245 is also PTAT.

In operation, the PTAT current generator 230 provides a linear PTAT current, I1, which is scaled down by the factor (a) by the second NMOS transistor 237. As was mentioned above, the factor (a) is desirably substantially equal to the collector to base current ratio factor beta ($\beta_F$) of a bipolar transistor. The third bipolar transistor qp1, 225 transforms the scaled PTAT linear current received from the second NMOS transistor 237 into a non-linear emitter current, I2, with an inherent collector to base current ratio factor beta ($\beta_F$). The emitter current of the third bipolar transistor 225 is mirrored by both the second PMOS transistor 240A and the third PMOS transistor 240B such that the first and second bipolar transistors are each biased, I3, I4, by the emitter current of the third bipolar transistor 225. The emitter current of the third bipolar transistor 225 is given by equation (9).

$$I_{emitter} = I_{PTAT} * (\beta_F + 1)/a \tag{9}$$

Due to the collector current density difference between the first bipolar transistor 205 and the second bipolar transistor 215, a base emitter voltage difference, ΔVbe, is developed across the sense resistor 219. Thus, a PTAT current flows through the sense resistor r2, 219 and into the emitter of the second bipolar transistor 215. The emitter currents of first bipolar transistor 205 and the second bipolar transistor 215 are unbalanced as emitter current of first bipolar transistor is substantially equal to the emitter current of the third bipolar transistor 225 while the emitter current of second bipolar transistor 215 is substantially equal to the emitter current of the third bipolar transistor 225 plus the PTAT current flowing through sense resistor r2, 219. This imbalance is such that the emitter and collector current of the second bipolar transistor 215 has a lower temperature coefficient compared to the first bipolar transistor 205 which inherently corrects the second order reference voltage curvature error which would otherwise be evident at the output of the op-amp 210. The reference voltage at the output of the amplifier 210 is the summation of the base emitter voltage (CTAT) of the first bipolar transistor 205 and the base emitter voltage difference ΔVbe (PTAT) between the first and second bipolar transistors 205, 215 as developed across the sense resistor 219, scaled by the ratio of resistors values of the feedback resistor 245 and the sense resistor 219.

Figure 3:
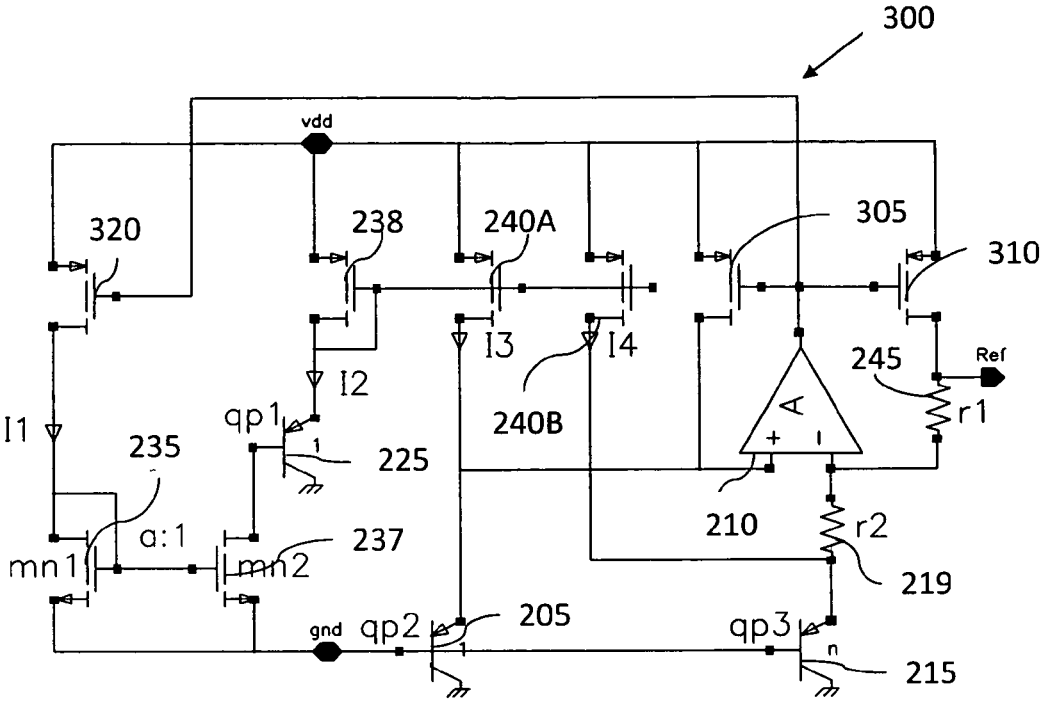
FIG. 3 is a schematic circuit diagram of a circuit provided in accordance with the teaching of the present invention.

Referring now to FIG. 3, there is illustrated another bandgap voltage reference circuit 300 with inherent reference voltage curvature correction as provided in accordance with the teaching of the present invention. The bandgap voltage reference circuit 300 is substantially similar to the bandgap voltage reference circuit 200, and like components are referenced by the same reference numerals. The main difference between the bandgap voltage reference circuit 300 and the bandgap voltage reference circuit 200 is that circuit elements that may be used to provide the PTAT current generator of FIG. 2 are shown. In this exemplary arrangement as to how a PTAT current generator may be provided, two PMOS transistors 305, 310 are provided. The gates of each of the PMOS transistors 305, 310 are driven by the output of the amplifier 210 and their sources are coupled to $V_{DD}$. The drain of the PMOS transistor 305 is coupled to the non-inverting terminal of the op-amp 210, and the drain of the PMOS transistor 310 is coupled to the feedback resistor, r1, 245. A PMOS transistor 320, the gate of which is also driven by the output of the op-amp 210 mirrors the PTAT current generated by PMOS transistors 305, 310. The drain of the PMOS transistor 320 is coupled to the first NMOS transistor 235. It will be appreciated that bar the inclusion of these specific circuit elements that otherwise, the operation of bandgap voltage reference circuit 300 is substantially similar to the bandgap voltage reference circuit 200.

Figure 1:
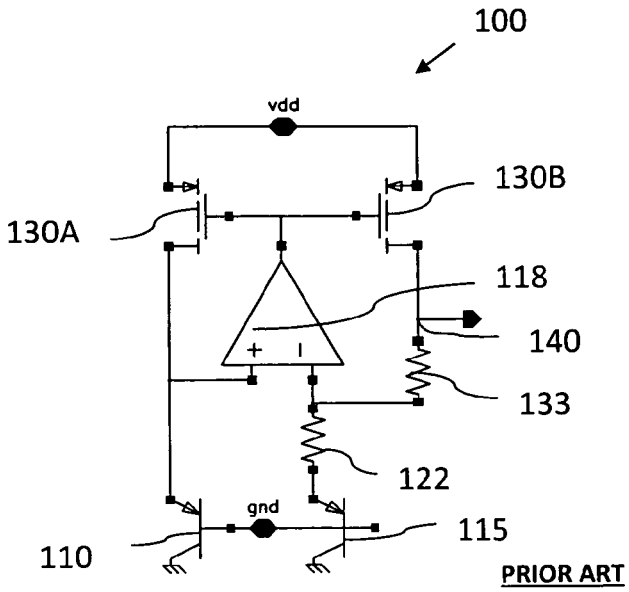
FIG. 1 is a schematic circuit diagram of prior art bandgap reference circuit.
Figure 4:
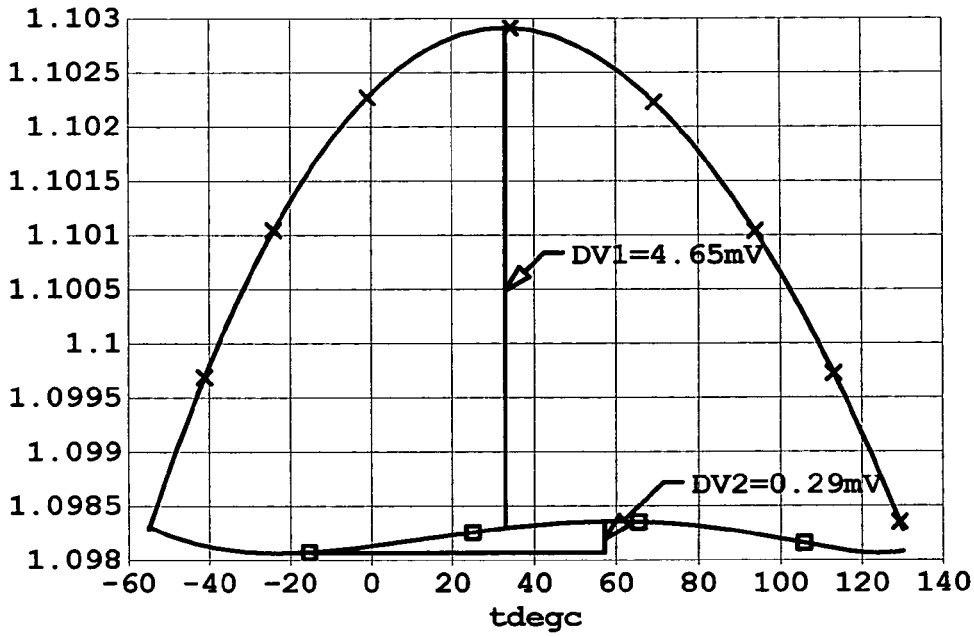
FIG. 4 is a graph showing comparisons in the reference voltage curvature of the circuit of FIG. 1 and the circuit of FIG. 2.

Referring now to graph of FIG. 4 which shows a simulated voltage reference output of the prior art bandgap voltage reference circuit 100 and the bandgap voltage reference circuit 300 over a temperature range from −55° C. to 130° C. For this simulation, the first, second and third bipolar transistors for both circuits are substrate bipolar transistors with model parameters of VG0=1.14V and XTI=4.5. The sense resistor 219 and the feedback resistor 245 are low Temperature Coefficient of Resistance (TCR) resistors. The uncorrected voltage reference of bandgap voltage reference circuit 100 displayed a reference voltage deviation, DV1, of 4.65 mV. In contrast and evidently much improved over the performance of the circuit of FIG. 1, the bandgap voltage reference circuit 300 displayed a reference voltage deviation, DV2, of 0.29 mV. These values correspond to a Temperature Coefficient (TC) of 22 ppm/° C. for the circuit 100 and 1.4 ppm/° C. for the circuit 300.

Figure 5:
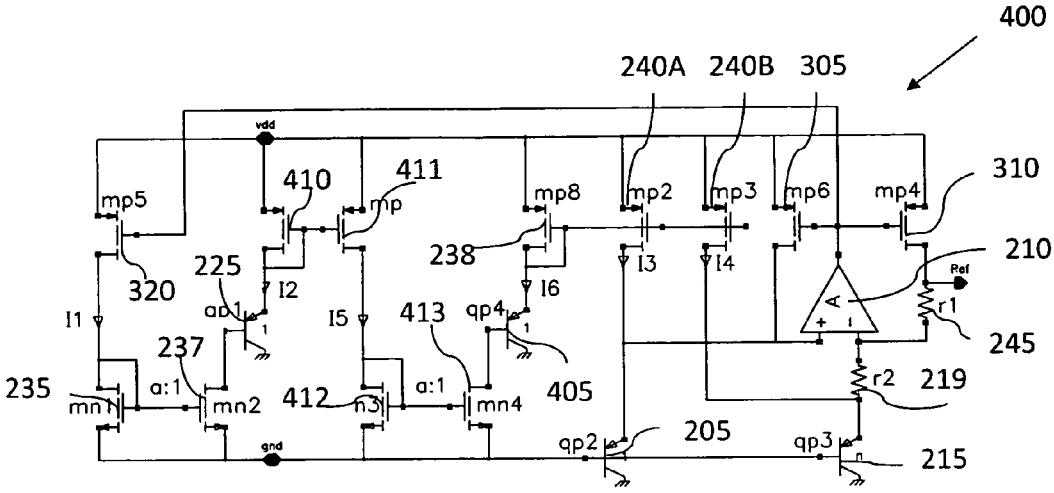
FIG. 5 is a schematic circuit diagram of a further circuit provided in accordance with the teaching of the present invention.

Referring now to FIG. 5, there is illustrated another bandgap voltage reference circuit 400 provided in accordance with the teaching of the present invention and again providing inherent reference voltage curvature correction. The bandgap voltage reference circuit 400 is substantially similar to the bandgap voltage reference circuits 200 and 300, and like components are referenced by the same reference numerals. The main difference between the bandgap voltage reference circuit 300 and the voltage reference circuit 400 is that a fourth bipolar transistor 405 and two MOS transistors pairs, 410, 411, 412, and 413 are provided. In a similar fashion to the bandgap voltage reference circuit 300, the base current of third bipolar transistor 225 is a PTAT current. The emitter current of the third bipolar transistor 225 is mirrored by the two MOS transistors pairs, 410, 411, 412, and 413 in order to provide the base current of the fourth bipolar transistor 405.

The emitter current of the fourth bipolar transistor, qp4, provides the biasing currents, I6, for the first bipolar transistor 205 and the second bipolar transistor 215. This current I6 is mirrored by the MOS device current mirror such that the first and second bipolar are provided with a biasing current I3, I4 respectively. The emitter current of the fourth bipolar transistor is provided having sufficient large temperature variation to reduce the non-linear voltage components of base-emitter voltages of the first bipolar transistor 205 and the second bipolar transistor 215.

It will be understood that in the arrangement of FIG. 5, that the base-emitter voltage of the first bipolar transistor 205 can be used as a high precision temperature sensor, in that its output is temperature dependent. It will further be appreciated that the fourth bipolar transistor 405 amplifies the non-linear characteristics of the emitter current received from the third bipolar transistor 225 which is then used to bias the first and second bipolar transistors 205, 215. Otherwise, the operation of bandgap voltage reference circuit 400 is substantially similar to the bandgap voltage reference circuit 200, with a reference voltage provided at the output of the amplifier A.

Figure 6:
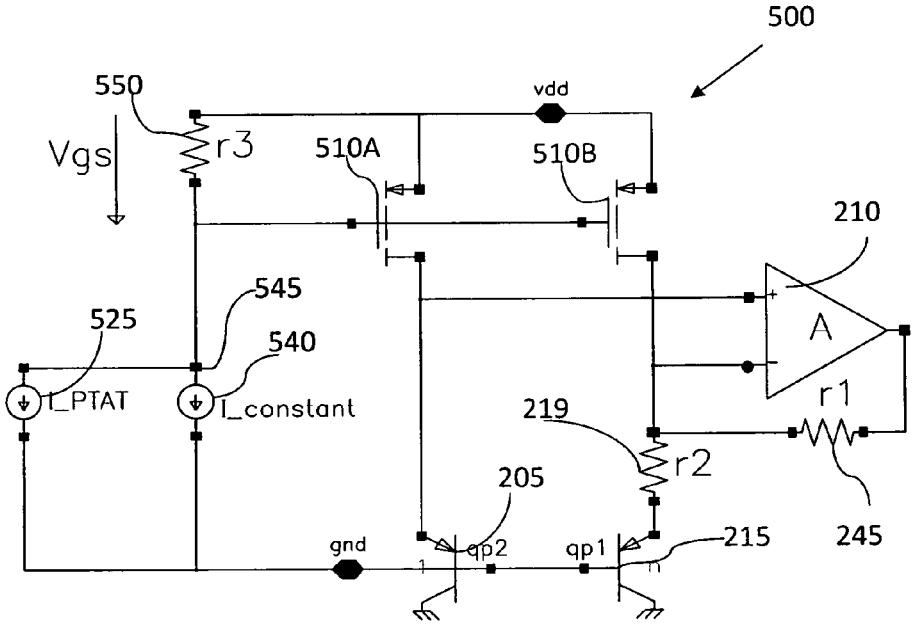
FIG. 6 is a schematic circuit diagram of a further circuit provided in accordance with the teaching of the present invention.

Referring now to FIG. 6, there is illustrated another bandgap voltage reference circuit 500 with inherent reference voltage curvature correction. The bandgap voltage reference circuit 500 is substantially similar to the bandgap voltage reference circuit 200, and like components are referenced by the same reference numerals. The main difference between the bandgap voltage reference circuit 500 and the bandgap voltage reference circuit 200 is that instead of the third bipolar device qp1, providing the non-linear biasing current for biasing the first and second bipolar transistors 205, 215 a pair of PMOS devices 510A, 510B are biased to provide the non-linear biasing current. A PTAT current source 525 provides a PTAT biasing current which sums with a constant biasing current provided by a constant current source 540 to form a summed current signal at summing node 545. The specifics of these current sources are not shown as they may be generated in any one of a number of different ways which will be appreciated by those skilled in the art. The summed current flows through a biasing resistor, r3, 550 coupled at one end to the $V_{DD}$ power supply and the other end to the summing node 545 across which a voltage drop is developed for driving the gates of the PMOS transistors 510A, and 510B, which are both coupled to the summing node 545. The constant biasing current provided by the constant current source 540 results in an offset voltage across the biasing resistor 550 which compensates for the threshold voltage of the PMOS transistors 510A and 510B and provides DC biasing for the PMOS transistors 510A, 510B. The PTAT biasing current provided by the PTAT current source 525 provides a linear voltage across the biasing resistor r3, 550. The voltage across the biasing resistor, r3, 550 provides the gate source voltages of the PMOS transistors 510A, 510B. Thus, the gate source voltages of the PMOS transistors 510A, 510B have a linear voltage component resulting from the PTAT current source 525, and an offset voltage component resulting from the constant current source 540. The linear voltage component of the gate source voltages causes the respective drain currents of the PMOS transistors 510A, 510B to be non-linear and quadratic in nature. In other words, the drains currents of the PMOS transistors 510A, 510B are of a second order form. The biasing of the first and second bipolar transistors 205, 215 with a non-linear signal effects compensation for the second order curvature effects prior to the generation of the voltage reference.

It will be understood that what has been described herein are exemplary embodiments of circuits which, by biasing the bipolar transistors provided at the inputs of the amplifier of a bandgap cell with a non-linear signal, achieve an inherent curvature correction of the generated voltage reference. The biasing of the transistors with a non-linear signal effects compensation for the second order curvature effects prior to the generation of the voltage reference. In this way no additional circuitry is required to subsequently achieve this correction. Where the provision of the non-linear signal has been described by coupling a semiconductor device such as a transistor to each of the two inputs terminals of the amplifier and using that semiconductor device to translate a received linear signal into a signal having a non linear form, such as an exponential or power signal, such correction may be effected without requiring large area devices such as resistors or amplifiers. While the present invention has been described with reference to exemplary arrangements and circuits it will be understood that it is not intended to limit the teaching of the present invention to such arrangements as modifications can be made without departing from the spirit and scope of the present invention. In this way it will be understood that the invention is to be limited only insofar as is deemed necessary in the light of the appended claims.

It will be understood that the use of the term "coupled" is intended to mean that the two devices are configured to be in electric communication with one another. This may be achieved by a direct link between the two devices or may be via one or more intermediary electrical devices.

Similarly the words comprises/comprising when used in the specification are used to specify the presence of stated features, integers, steps or components but do not preclude the presence or addition of one or more additional features, integers, steps, components or groups thereof.

I claim:

1. A curvature corrected bandgap voltage reference circuit comprising:

an amplifier having an inverting terminal, a non-inverting terminal and an output terminal, at least one first and second bipolar transistor operable at different current densities each transistor associated with a corresponding one of the inverting and non-inverting terminals of the amplifier such that a voltage difference of the form of a ΔVbe is reflected across a first load element, and a current biasing circuit including:

a semiconductor device configured for receiving a linear bias current and for outputting a non-linear bias current; and a circuit arrangement for delivering the linear biasing current to the semiconductor device and for delivering the non-linear biasing current from the semiconductor device to the first and second bipolar transistors.

2. A curvature corrected bandgap voltage reference circuit as claimed in claim 1, wherein the semiconductor device comprises a third bipolar transistor.

3. A curvature corrected bandgap voltage reference circuit as claimed in claim 2, wherein the third bipolar transistor transforms the linear bias current into an emitter current with an inherent gain characteristic.

4. A curvature corrected bandgap voltage reference circuit as claimed in claim 1, wherein the current biasing circuit further comprises a pair of MOS devices each coupled to a corresponding one of the first and second bipolar transistors.

5. A curvature corrected bandgap voltage reference circuit as claimed in claim 4, wherein each MOS device is biased for providing a drain current with second order characteristics to the corresponding one of the first and second bipolar transistors.

6. A curvature corrected bandgap voltage reference circuit as claimed in claim 1, wherein the current biasing circuit further comprises a current generator for generating the linear bias current.

7. A curvature corrected bandgap voltage reference circuit as claimed in claim 6, wherein the current biasing circuit further comprises a first mirroring arrangement for delivering the linear bias current to the semiconductor device and a second mirroring arrangement for delivering the non-linear bias current from the semiconductor device to the first and second bipolar transistors.

8. A curvature corrected bandgap voltage reference circuit as claimed in claim 7, wherein the first mirroring arrangement scales the linear bias current by a predetermined factor prior to the semiconductor device receiving thereof.

9. A curvature corrected bandgap voltage reference circuit as claimed in claim 1, wherein the linear biasing current is a PTAT current.

10. A curvature corrected bandgap voltage reference circuit as claimed in claim 1, wherein the first load element is coupled between the second bipolar transistor and the inverting terminal of the amplifier.

11. A curvature corrected bandgap voltage reference circuit as claimed in claim 10, wherein a second load element is coupled between the inverting terminal and the output of the amplifier such that the voltage at the output of amplifier is a summation of a PTAT voltage and a CTAT voltage.

12. A curvature corrected bandgap voltage reference circuit as claimed in claim 3, wherein the circuit further comprises at least one fourth bipolar device arranged in the current biasing circuit for receiving the emitter current of the third bipolar device for amplifying the non-linear characteristics thereof.

13. A curvature corrected bandgap voltage reference circuit as claimed in claim 1 wherein the semiconductor device is configured to generate a biasing current having an exponential form.

14. A curvature corrected bandgap voltage reference circuit as claimed in claim 1 wherein the semiconductor device is configured to generate a biasing current having a second order form.

15. A current biasing circuit for biasing a bandgap voltage reference circuit of the type including:

an amplifier having an inverting terminal, a non-inverting terminal and an output terminal;

at least one first and second bipolar transistors operable at different current densities each coupled to a corresponding one of the inverting and non-inverting terminals of the amplifier;

the current biasing circuit further comprising:

a semiconductor device configured for receiving a linear bias current and operable for transforming the linear bias current into a second order non-linear bias current; and a mirroring arrangement for delivering the linear biasing current to the semiconductor device and for delivering the second order non-linear bias current to the first and second bipolar transistors for biasing thereof.

16. A current biasing circuit as claimed in claim 15, wherein the current biasing circuit further comprises a current generator for generating the linear biasing current.

17. A current biasing circuit as claimed in claim 15, wherein the mirroring arrangement scales the linear biasing current by a predetermined factor prior to the semiconductor device receiving thereof.

18. A current biasing circuit as claimed in claim 15, wherein the semiconductor device is a third bipolar transistor of the circuit, the third bipolar transistor being configured for transforming the linear biasing current to an emitter current with an inherent gain characteristic.

19. A current biasing circuit as claimed in claim 15, wherein the semiconductor device comprises a MOS transistor.

20. A curvature corrected bandgap voltage reference circuit, the circuit comprising:

an amplifier having an inverting terminal, a non-inverting terminal and an output terminal, at least one first and second bipolar transistors operable at different current densities such that a ΔVbe is reflected across a first load element coupled to one of the input terminals of the amplifier, and a third bipolar transistor configured for receiving a linear PTAT current and operable for transforming the linear PTAT current into an emitter current; and mirroring arrangement for delivering the linear PTAT current to the third bipolar transistor and for delivering the emitter current from the third bipolar transistor to the first and second bipolar transistors for biasing thereof.

21. A curvature corrected bandgap voltage reference circuit, the circuit comprising:

an amplifier having an inverting terminal, a non-inverting terminal and an output terminal, at least one first and second bipolar transistors operable at different current densities such that a ΔVbe is reflected across a first load element coupled to one of the input terminals of the amplifier, a third bipolar device configured for receiving a linear bias PTAT current and operable for transforming the linear bias PTAT current into an emitter current which is relayed to the first and second bipolar devices for biasing thereof, a PTAT current generator for generating the linear bias PTAT current, and a mirroring arrangement for delivering the linear bias PTAT current to the base of the third bipolar device and for delivering the emitter current from the third bipolar device to the first and second bipolar transistors.

22. A curvature corrected bandgap voltage reference circuit, the circuit comprising:

an amplifier having an inverting terminal, a non-inverting terminal and an output terminal, at least one first and second bipolar transistors operable at different current densities such that a ΔVbe is reflected across a first load element coupled to one of the input terminals of the amplifier, a third bipolar transistor configured for receiving a linear bias PTAT current and operable for transforming the linear bias PTAT current into an emitter current, a fourth bipolar transistor configured for receiving the emitter current from the third bipolar transistor and operable for deriving a second emitter current therefrom with amplified non-linear characteristics which is relayed to the first and second bipolar devices for biasing thereof.

23. A curvature corrected bandgap voltage reference circuit comprising:

an amplifier having an inverting terminal, a non-inverting terminal and an output terminal, at least one first and second bipolar transistors operable at different current densities each associated with a corresponding one of the inverting and non-inverting terminals of the amplifier such that a voltage difference of the form of a ΔVbe is reflected across a first load element, and a current biasing circuit including:

a semiconductor device configured for receiving a linear PTAT current and for outputting a non-linear emitter current; and a circuit arrangement for delivering the linear PTAT current to the semiconductor device and for delivering the non-linear emitter current from the semiconductor device to the first and second bipolar transistors.

24. A curvature corrected bandgap voltage reference circuit comprising:

an amplifier having an inverting terminal, a non-inverting terminal and an output terminal, at least one first and second transistors each coupled to a corresponding one of the inverting and non-inverting terminals of the amplifier such that a PTAT voltage is reflected across a first load element, and a current biasing circuit including:

a semiconductor device configured for receiving a linear bias current and operable for transforming the linear bias current into a non-linear bias current; and a mirror arrangement for delivering a linear biasing current to the semiconductor device and for delivering a non-linear biasing current from the semiconductor device to the first and second bipolar transistors.

25. A curvature corrected bandgap voltage reference circuit comprising:

an amplifier having a first input, a second input and an output, at least one first and second transistors each associated with a corresponding one of the inputs of the amplifier such that a PTAT voltage is reflected across a first load element, and a current biasing circuit including:

a semiconductor device configured for receiving a linear bias current and operable for transforming the linear bias current into a non-linear bias current; and a mirroring arrangement for delivering a linear biasing current to the semiconductor device and for delivering a non-linear biasing current for the semiconductor device to the first and second transistors.

26. A curvature corrected bandgap voltage reference circuit comprising:

an amplifier having a first input, a second input and an output, at least one first and second transistors each associated with a corresponding one of the inputs of the amplifier such that a PTAT voltage is reflected across a first load element, and a current biasing circuit including:

a semiconductor device configured for receiving a PTAT current and operable for transforming the PTAT current into an emitter current, and a mirroring arrangement for delivering the PTAT current to the semiconductor device and for delivering the emitter current from the semiconductor device to the first and second transistors.

27. A curvature corrected bandgap voltage reference circuit comprising:

an amplifier having a first input, a second input and an output, at least one first and second transistors each associated with a corresponding one of the inputs of the amplifier such that a PTAT voltage is reflected across a first load element, and a current biasing circuit including:

a semiconductor device configured for receiving a PTAT current and for outputting an emitter current; and a circuit arrangement for delivering the PTAT current to the semiconductor device and for delivering the emitter current from the semiconductor device to the first and second transistors.

* * * * *